US011761642B2

(12) United States Patent
Perkinson et al.

(10) Patent No.: US 11,761,642 B2
(45) Date of Patent: Sep. 19, 2023

(54) AIR DIFFUSER FOR LOCALIZED CLIMATE CONTROL

(71) Applicant: Air Distribution Technologies IP, LLC, Milwaukee, WI (US)

(72) Inventors: Ryan M. Perkinson, Plano, TX (US); Kazim C. Demirhan, Garland, TX (US); Brian J. Graham, Grand Prairie, TX (US); Gary A. Minor, Flower Mound, TX (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 0 days.

(21) Appl. No.: 17/892,936

(22) Filed: Aug. 22, 2022

(65) Prior Publication Data

US 2023/0044355 A1 Feb. 9, 2023

Related U.S. Application Data

(63) Continuation of application No. 16/379,202, filed on Apr. 9, 2019, now Pat. No. 11,421,897.

(60) Provisional application No. 62/826,641, filed on Mar. 29, 2019.

(51) Int. Cl.
*F24F 1/01* (2011.01)
*F24F 13/26* (2006.01)

(52) U.S. Cl.
CPC ..... *F24F 1/01* (2013.01); *F24F 13/26* (2013.01)

(58) Field of Classification Search
CPC ..... F24F 1/01; F24F 13/26; F24F 2013/0612; F24F 2013/0616; F24F 13/06; F24F 13/04
See application file for complete search history.

(56) References Cited

U.S. PATENT DOCUMENTS 2,663,244 A 12/1953 Macdowell
2,681,182 A * 6/1954 McGrath ..... F24F 3/04 261/115
2,899,180 A 8/1959 Allander et al.
3,895,567 A 7/1975 Paul
(Continued)

FOREIGN PATENT DOCUMENTS

CA 2957726 A1 3/2016
CA 3043996 A1 2/2018
(Continued)

OTHER PUBLICATIONS

Coolinglogic, "CoolingLogic: Up early, saving billions." URL: http://coolinglogic.com/documents/MarketingFlyer_FINAL_HiRes8.5x11.pdf, retrieved from internet Oct. 27, 2022 (1 page).
(Continued)

*Primary Examiner* — Jessica Yuen
(74) *Attorney, Agent, or Firm* — Fletcher Yoder, PC

(57) ABSTRACT

An air diffuser of a heating, ventilation, and/or air conditioning (HVAC) system includes a mixing chamber having a circulation inlet and a mixing region, a room air intake fluidly coupled with the circulation inlet and separated from the mixing region by a blank-off plate, and a nozzle. The nozzle is disposed adjacent to the circulation inlet and configured to accelerate a conditioned air flow into the mixing region such that unconditioned room air is induced by the conditioned air flow to enter the mixing region through the circulation inlet and from the room air intake.

20 Claims, 6 Drawing Sheets

(56) References Cited

U.S. PATENT DOCUMENTS

| | | | | |
|---|---|---|---|---|
| 5,259,817 | A | 11/1993 | Schumacher et al. | |
| 9,447,985 | B2 | 9/2016 | Johnson | |
| 9,625,166 | B2 | 4/2017 | Hirsch et al. | |
| 10,871,756 | B2 | 12/2020 | Johnson et al. | |
| 10,908,578 | B2 | 2/2021 | Johnson et al. | |
| 10,921,768 | B2 | 2/2021 | Johnson et al. | |
| 11,156,978 | B2 | 10/2021 | Johnson et al. | |
| 11,421,897 | B2 * | 8/2022 | Perkinson | F24F 1/01 |
| 2018/0128512 | A1 | 5/2018 | Costello et al. | |

FOREIGN PATENT DOCUMENTS

| | | |
|---|---|---|
| DE | 2938702 | 4/1981 |
| DE | 19525945 | 1/1997 |
| EP | 1130331 | 5/2004 |
| EP | 3 186 687 A4 | 7/2017 |
| EP | 3 497 377 A1 | 6/2019 |
| GB | 751946 | 7/1956 |
| JP | 04366330 | 12/1992 |

OTHER PUBLICATIONS

Incomplete File of Communication with Various Companies, etc. in 2016-2021, URL: http://coolinglogic.com/documents/22072101_Letters_and_Signature_Receipts.pdf, published, as one document, on: Jul. 21, 2022 (211 pages).

Johnson Heating and Cooling L.L.C., "Divine Grace Building Automation (Images)," URL: http://cooljohnson.com/Building-Automation-Systems-Michigan/Oakland-County-Michigan/Building-Automation-Images.html, retrieved from internet Oct. 27, 2022 (8 pages).

Johnson Heating and Cooling L.L.C., "Divine Grace Building Automation," URL: http://cooljohnson.com/Building-Automation-Systems-Michigan/Oakland-County-Michigan/Building-Automation-Divine-Grace.html, retrieved from internet Oct. 27, 2022 (3 pages).

Johnson Heating and Cooling L.L.C., "Excel Rehabilitation Building Automation," URL: http://cooljohnson.com/Building-Automation-Systems-Michigan/Waterford-Michigan/Building-Automation-System-Excel.html, retrieved from internet Oct. 27, 2022 (2 pages).

Johnson Heating and Cooling L.L.C., "Intertek Testing Services Building Automation," URL: http://cooljohnson.com/Building-Automation-Systems-Michigan/Plymouth-Michigan/Building-Automation-System-Plymouth-Michigan.html, retrieved from internet Oct. 27, 2022 (8 pages).

Johnson Heating and Cooling L.L.C., "JLA Medical Building Building Automation," URL: http://cooljohnson.com/Building-Automation-Systems-Michigan/Waterford-Michigan/Building-Automation-System-JLA.html, retrieved from internet Oct. 27, 2022 (3 pages).

Johnson Heating and Cooling L.L.C., "Mosaic Christian Building Automation (Images)," URL: http://cooljohnson.com/Building-Automation-Systems-Michigan/Detroit/Building-Automation-Images.html, retrieved from internet Oct. 27, 2022 (12 pages).

Johnson Heating and Cooling L.L.C., "Mosaic Christian Building Automation," URL: http://cooljohnson.com/Building-Automation-Systems-Michigan/Detroit/Mosaic-Christian.html, retrieved from internet Oct. 27, 2022 (5 pages).

Johnson Heating and Cooling L.L.C., "Shepherd's Gate Lutheran Church Building Automation," URL: http://cooljohnson.com/Building-Automation-Systems-Michigan/Shelby-Township-Michigan/Building-Automation-Systems-SG.html, retrieved from internet Oct. 27, 2022 (3 pages).

Johnson Heating and Cooling L.L.C., "St. Clair County Residence Building Automation," URL: http://cooljohnson.com/Building-Automation-Systems-Michigan/St-Clair-Michigan/Building-Automation-System-St-Clair-Michigan.html, retrieved from internet Oct. 27, 2022 (4 pages).

Johnson Heating and Cooling L.L.C., "St. Joseph Mercy Oakland U. C. Building Automation," URL: http://cooljohnson.com/Building-Automation-Systems-Michigan/Waterford-Michigan/Building-Automation-Systems-SJMO.html, retrieved from internet Oct. 27, 2022 (2 pages).

Johnson Heating and Cooling L.L.C., "Waterford Internal Medicine Building Automation," URL: http://cooljohnson.com/Building-Automation-Systems-Michigan/Waterford-Michigan/Building-Automation-Systems-WIM.html, retrieved from internet Oct. 27, 2022 (3 pages).

Johnson Heating and Cooling, LLC, "Building Automation Clawson Michigan 2.0," URL: http://cooljohnson.com/Building-Automation-Systems-Michigan/Clawson-Michigan/Building-Automation-Clawson-Manor-2.html, retrieved from the internet Oct. 27, 2022 (6 pages).

Johnson Heating and Cooling, LLC, "Building Automation Images Clawson Michigan 2.0," URL: http://cooljohnson.com/Building-Automation-Systems-Michigan/Clawson-Michigan/Building-Automation-Clawson-Manor-2-Images.html, retrieved from the internet Oct. 27, 2022 (14 pages).

Johnson Heating and Cooling, LLC, "Building Automation System Clawson Michigan Clawson Manor," URL: http://cooljohnson.com/Building-Automation-Systems-Michigan/Clawson-Michigan/Building-Automation-System-Clawson-Manor.html; retrieved from the internet Oct. 27, 2022 (3 pages).

Johnson Heating and Cooling, LLC, "Building Automation System in Michigan Images," URL: http://cooljohnson.com/Building-Automation-Systems-Michigan/Macomb-County-Michigan/Building-Automation-Images.html; retrieved from the internet Oct. 27, 2022 (13 pages).

Johnson Heating and Cooling, LLC, "Building Automation System in Michigan," URL: http://cooljohnson.com/Building-Automation-Systems-Michigan/Macomb-County-Michigan/Building-Automation-Confidential-Customer.html; retrieved from the internet, Oct. 27, 2022 (4 pages).

Johnson Solid State LLC, "Building Automation Equipment," URL: http://cooljohnson.com/Video/Building_Automation/Confidential_Customer_BLD_2/Building_Automation_Equipment.mp4, retrieved from internet Oct. 27, 2022 (35 pages).

Johnson Solid State LLC, "Building Automation GUI," URL: http://cooljohnson.com/Video/Building_Automation/Confidential_Customer_BLD_2/Building_Automation_GUI.mp4, retrieved from internet Oct. 27, 2022 (24 pages).

Johnson Solid State LLC, "Cooling Logic Overview," URL: http://coolinglogic.com/documents/CoolingLogic_Overview_High_Quality.mp4, retrieved from internet Oct. 27, 2022 (16 pages).

Johnson Solid State LLC, "So what is CoolingLogic™?" URL: http://coolinglogic.com/Coolinglogic-How-it-Works.html, retrieved from the internet Oct. 27, 2022 (3 pages).

Johnson, David, "A Method to Increase HVAC System Efficiency And Decrease Energy Consumption," White Paper: Johnson Solid State, LLC, URL: http://coolinglogic.com/documents/16102106_White_Paper_High_Resolution_Protected.pdf, Sep. 24, 2016 (51 pages).

Johnson, David, "CoolingLogic™: Mosaic Christian Church A Case Study," Report: Johnson Solid State, LLC, URL: http://coolinglogic.com/documents/19020301_Mosaic_Christian_Coolinglogic_Case_Study.pdf, Feb. 2, 2019 (140 pages).

Johnson, David, "Excel Rehabilitation Building Automation: Building Automation System User Manual ," URL: http://cooljohnson.com/Building-Automation-Systems-Michigan/Waterford-Michigan/Building-Automation-System-Excel-Manual.html, 2012 (10 pages).

Johnson, David, "Temperature Control System and Methods for Operating Same," Pre-Publication printout of U.S. Appl. No. 15/231,943, filed Aug. 9, 2016, URL: http://coolinglogic.com/documents/16080901_CIP_As_Filed.pdf (99 pages).

Johnson, David., "CoolingLogic™: Changing the Way You Cool," Report: Johnson Solid State, LLC, URL: http://coolinglogic.com/documents/18111303_Changing_the_way_you_Cool.pdf, Nov. 7, 2018 (12 pages).

* cited by examiner

AIR DIFFUSER FOR LOCALIZED CLIMATE CONTROL

CROSS REFERENCE TO RELATED APPLICATION

This application is a continuation of U.S. patent application Ser. No. 16/379,202, entitled "AIR DIFFUSER FOR LOCALIZED CLIMATE CONTROL," filed Apr. 9, 2019, which claims priority from and the benefit of U.S. Provisional Application Ser. No. 62/826,641, entitled "AIR DIFFUSER FOR LOCALIZED CLIMATE CONTROL," filed Mar. 29, 2019, which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

A wide range of applications exist for HVAC systems. For example, residential, light commercial, commercial, and industrial systems are used to control temperatures and air quality in residences and buildings. Generally, HVAC systems may circulate a fluid, such as a refrigerant, through a closed loop between an evaporator coil, where the fluid absorbs heat, and a condenser, where the fluid releases heat. The fluid flowing within the closed loop is generally formulated to undergo phase changes within the normal operating temperatures and pressures of the system, so that quantities of heat can be exchanged by virtue of the latent heat of vaporization of the fluid. A fan or fans may blow air over the coils of the heat exchanger(s) in order to condition the air. In other embodiments, a chiller and boiler may be utilized to cool and heat water, and the above-described fan or fans may blow air over, for example, a conduit which receives the temperature-controlled water. The air may then be routed toward a space, through ductwork, for example, to condition the space. A diffuser at an end of the ductwork may distribute the conditioned air to the space.

Certain traditional diffusers may be configured to throw the conditioned air a specified distance from the diffuser before the conditioned air substantially decelerates. Further, certain traditional diffusers may be configured to mix a portion of conditioned air with a portion of recirculated room air, and to throw the mixed air a specified distance from the diffuser before the mixed air substantially decelerates. Unfortunately, traditional diffusers may inefficiently mix the conditioned air and the room air, and may be incapable of throwing the air a desirable distance from the diffuser.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to an air diffuser of a heating, ventilation, and/or air conditioning (HVAC) system. The air diffuser includes a mixing chamber having a circulation inlet and a mixing region, a room air intake fluidly coupled with the circulation inlet and separated from the mixing region by a blank-off plate, and a nozzle. The nozzle is disposed adjacent to the circulation inlet and configured to accelerate a conditioned air flow into the mixing region such that unconditioned room air is induced by the conditioned air flow to enter the mixing region through the circulation inlet and from the room air intake.

The present disclosure also relates to a heating, ventilation, and/or air conditioning (HVAC) system including an air diffuser. The air diffuser includes a mixing chamber having a mixing region configured to receive conditioned air from a nozzle of the air diffuser and unconditioned room air from a circulation inlet of the air diffuser. The air diffuser also includes a blank-off plate configured to separate the mixing region from a room air intake fluidly coupled to the circulation inlet. The air diffuser also includes an additional plate partially forming a mixed air outlet of the air diffuser and extending at an oblique angle relative to the blank-off plate.

The present disclosure also relates to an air diffuser. The air diffuser includes a mixing chamber having a mixing region and a circulation inlet fluidly coupled to the mixing region and to a room air intake. The air diffuser also includes a nozzle configured to accelerate a conditioned air flow into the mixing region such that the conditioned air flow induces unconditioned room air to enter the mixing region through the circulation inlet and from the room air intake. The air diffuser also includes a blank-off plate configured to separate the room air intake and the mixing region.

DETAILED DESCRIPTION

Figure 1:
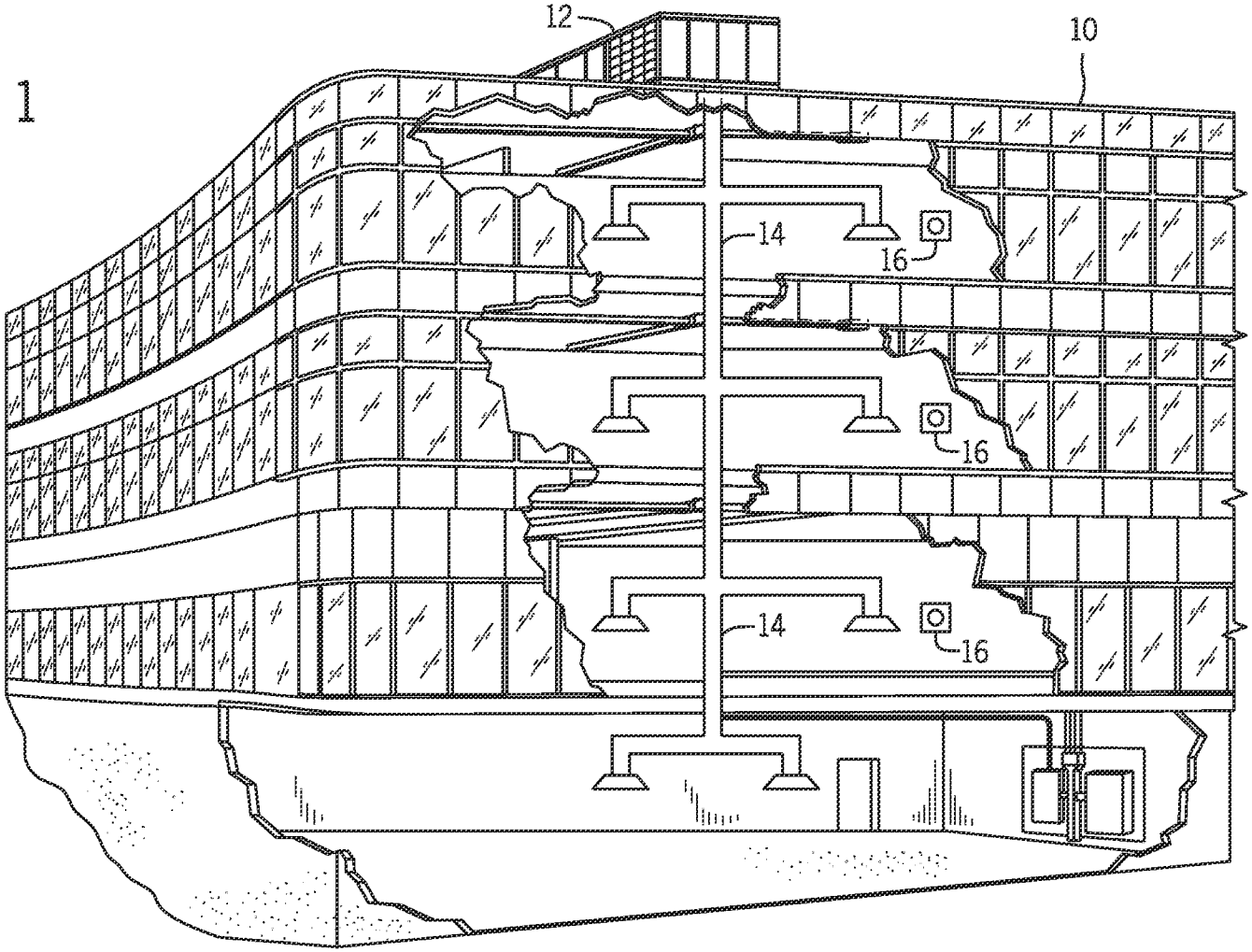
FIG. 1 is a perspective view a heating, ventilation, and/or air conditioning (HVAC) system for building environmental management, in accordance with an aspect of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure relates generally to a heating, ventilation, and/or air conditioning (HVAC) system. More particularly, the present disclosure is directed toward an air diffuser of the HVAC system.

In accordance with present embodiments, an air diffuser may include a mixing chamber and nozzles configured to accelerate a conditioned air flow into a mixing region of the mixing chamber. A circulation inlet to the mixing chamber may be fluidly coupled with a room air intake. The conditioned air flow received by the mixing region may induce unconditioned room air to enter the mixing region through the circulation inlet and from the room air intake. "Unconditioned room air" as used herein refers to a volume of room air recycled from a conditioned space, and that has not been cooled/heated by cooling/heating coils since its previous use in the conditioned space. That is, the "unconditioned room air" is of a temperature or quality unsuitable for independently conditioning the space, and is drawn into the mixing region without passing over cooling or heating coils, such that the unconditioned room air can be mixed with conditioned air and the mixed air volume can be used to condition the space.

A blank-off plate may separate the room air intake from the mixing region such that room air is blocked from entering the mixing region adjacent to the blank-off plate, and instead enters the mixing region through the circulation inlet disposed adjacent the conditioned air nozzles. That is, the blank-off plate and circulation inlet are configured to control a location through which room air is received by the mixing region, and an amount of room air received by the mixing region. This control enables the recycling of the unconditioned room air without having to independently cool/heat the unconditioned room air via cooling/heating coils. The room air and conditioned air may be mixed in the mixing region to generate mixed air.

In general, the mixed air may be output from the air diffuser into a space to condition the space. A mixed air outlet of the air diffuser may be defined between a portion of the blank-off plate and an additional plate opposite to the portion of the blank-off plate. That is, the additional plate and the portion of the blank-off plate may define the mixed air outlet. The additional plate may extend at an oblique angle relative to the portion of the blank-off plate, and the mixed air may flow along the additional plate at the oblique angle, which may improve air flow velocity and a throwing distance of the air diffuser. For example, the oblique angle of the additional plate may cause the Coanda effect, which describes a tendency of the mixed air flow to attach to the surface of the additional plate, thereby improving an air flow velocity of the mixed air flow relative to traditional embodiments having more turbulent air flow through the diffuser outlet.

In certain HVAC systems, the above-described air diffuser may be utilized to condition a large space, such as a factory space or a hangar space. In general, peripheral or perimeter areas of the large space immediately adjacent walls defining the large space may not require substantial conditioning, as central areas of the large space are more often utilized than the perimeter. Thus, by enhancing a throw of the diffuser, the mixed air is more efficiently utilized to condition the central areas of the large space. Further, by controlling the location at which the room air is received by the mixing region of the mixing chamber for mixing with the conditioned air, the air diffuser may more efficiently ventilate and condition the mixed air output, which is utilized to condition the large space. For example, the above-described circulation features may improve adiabatic mixing of the room air and the conditioned air in the mixing region, relative to embodiments which do not include similar flow separation features, thereby improving flow velocity and mixed air temperature. These and other features will be described in detail below with reference to the drawings.

Turning now to the drawings, FIG. 1 illustrates a heating, ventilation, and/or air conditioning (HVAC) system for building environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an HVAC system may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single, packaged unit containing other equipment, such as a blower, integrated air handler, and/or auxiliary heating unit. In other embodiments, the HVAC unit 12 may be part of a split HVAC system, which includes an outdoor HVAC unit and an indoor HVAC unit.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

It should be appreciated that any of the features described herein may be incorporated with the HVAC unit 12, residential heating and cooling systems, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Further, in accordance with an aspect of the present disclosure, an air diffuser may be included in the building 10, for example at an end or terminal of the ductwork 14, and may be configured to distribute or throw an air flow into the conditioned space. For example, the air diffuser may include a mixing chamber and nozzles configured to accelerate a conditioned air flow into a mixing region of the mixing chamber. A circulation inlet to the mixing chamber may be fluidly coupled with a room air intake, and the conditioned air flow received by the mixing region may induce room air to enter the mixing region through the circulation inlet and from the room air intake. A blank-off plate may separate the room air intake from the mixing region such that room air is blocked from entering the mixing region adjacent to the blank-off plate, and instead enters the mixing region through the circulation inlet. That is, the blank-off plate and circulation inlet are configured to control a location through which room air is received by the mixing region. The room air and conditioned air may be mixed in the mixing region to generate mixed air. By including the blank-off plate to control a location at which room air enters the mixing region, adiabatic mixing of the conditioned air and the room air in the mixing region may be improved over traditional embodiments, thereby improving flow velocity and mixed air temperature.

Further, an additional plate disposed across the mixing region from the blank-off plate may define a mixed air outlet of the air diffuser between the additional plate and a portion of the blank-off plate. The additional plate may extend at an oblique angle relative to the portion of the blank-off plate, and the mixed air may flow along the additional plate at the oblique angle, which may improve air flow velocity and a throwing distance of the air diffuser. For example, the oblique angle of the additional plate may cause the Coanda effect, which describes a tendency of the mixed air flow to attach to the surface of the additional plate, thereby improving an air flow velocity of the mixed air flow relative to traditional embodiments having more turbulent air flow through the diffuser outlet. These and other features will be described in detail below with reference to the drawings.

Figure 2:
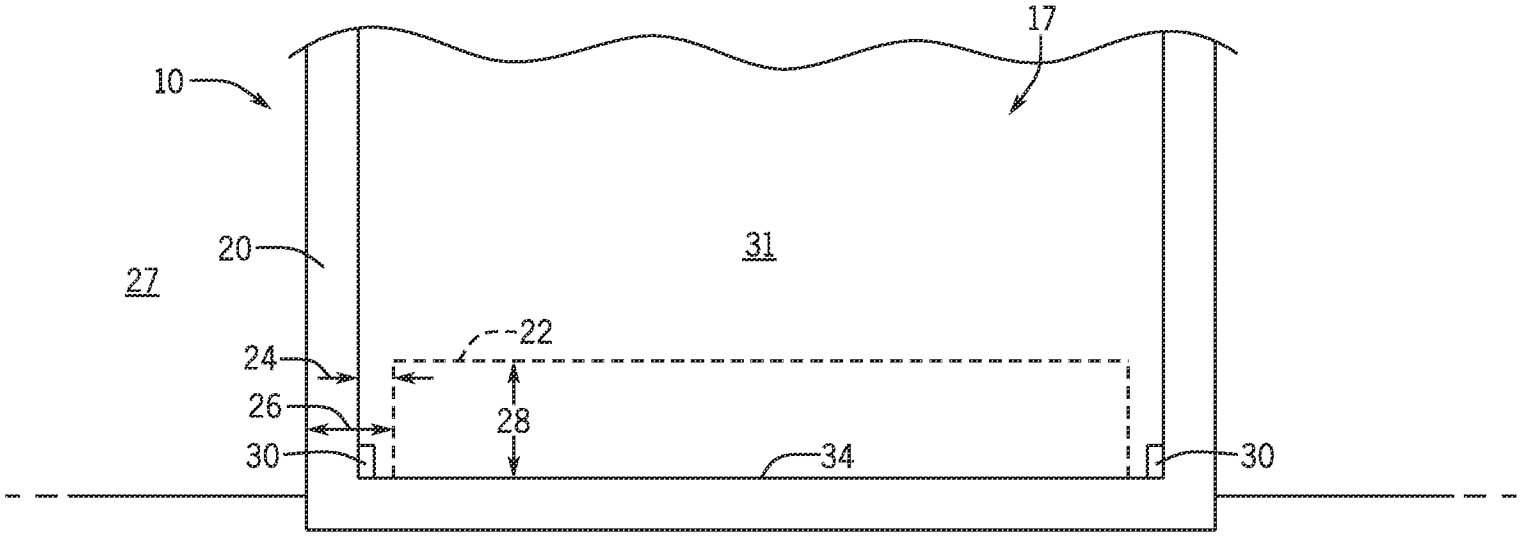
FIG. 2 is a schematic illustration of a space requiring conditioning by, for example, the HVAC system of FIG. 1, in accordance with an aspect of the present disclosure.

FIG. 2 is a schematic illustration of an embodiment of a space 17 of a building 10 requiring conditioning by, for example, the HVAC system of FIG. 1. The space 17 may be defined at least in part by walls 20 and a floor 34, where the floor 34 may be referred to with reference to later drawings as a work platform. In the illustrated embodiment, the building 10 and corresponding space 17 may be representative of a large area requiring conditioning, such as a hangar or a factory. Since the entire space 17 may be large and may not be occupied in a way that requires air conditioning, such as cooling, heating, and/or ventilation, it may be efficient to concentrate air conditioning on an occupied zone 22 defined within the space 17. Further, regulatory guidelines or industry standards may require that the occupied zone 22 be air conditioned.

The occupied zone 22 may generally be defined by a zone in which humans occupy the space 17. However, certain industry standards may require that, in the absence of known occupant locations, or in the event known occupant locations fluctuate, the occupied zone 22 be defined from the floor 34 to a location 1.8 meters (6 feet) above the floor 34. That is, the illustrated height 28 of the occupied zone 22 in certain embodiments may be, at minimum, 1.8 meters (6 feet). Further, certain industry standards may require that, in the absence of known occupant locations, the occupied zone 22 begin a distance 24 of 0.3 meters (1 foot) from the wall 20 defining the space or a distance 26 of 1.0 meters (3.3 feet) from an external environment 27. In the illustrated embodiment, the wall 20 is sized such that the distance 24 of 0.3 meters (1 foot) from the wall 20 and the distance 26 of 1.0 meters (3 feet) from the external environment 27 terminate at an equivalent location within the space 17, namely, the boundary of the occupied zone 22. If the distances 24, 26 terminate at different locations within the space 17 in other embodiments, the distance 24, 26 furthest inward from the wall 20 may define the boundary of the occupied zone 22.

In accordance with present embodiments, air diffusers 30 may be configured to condition the occupied zone 22. That is, the air diffusers 30 may be configured to concentrate air conditioning efforts on the occupied zone 22, as opposed to an unoccupied zone 31. By concentrating air conditioning resources on the occupied zone 22, as opposed to the unoccupied zone 31, efficiency of the air conditioning features is improved. As will be appreciated in view of descriptions below referencing later drawings, the air diffusers 30 may distribute or throw conditioned air flow into the occupied zone 22.

Figure 3:
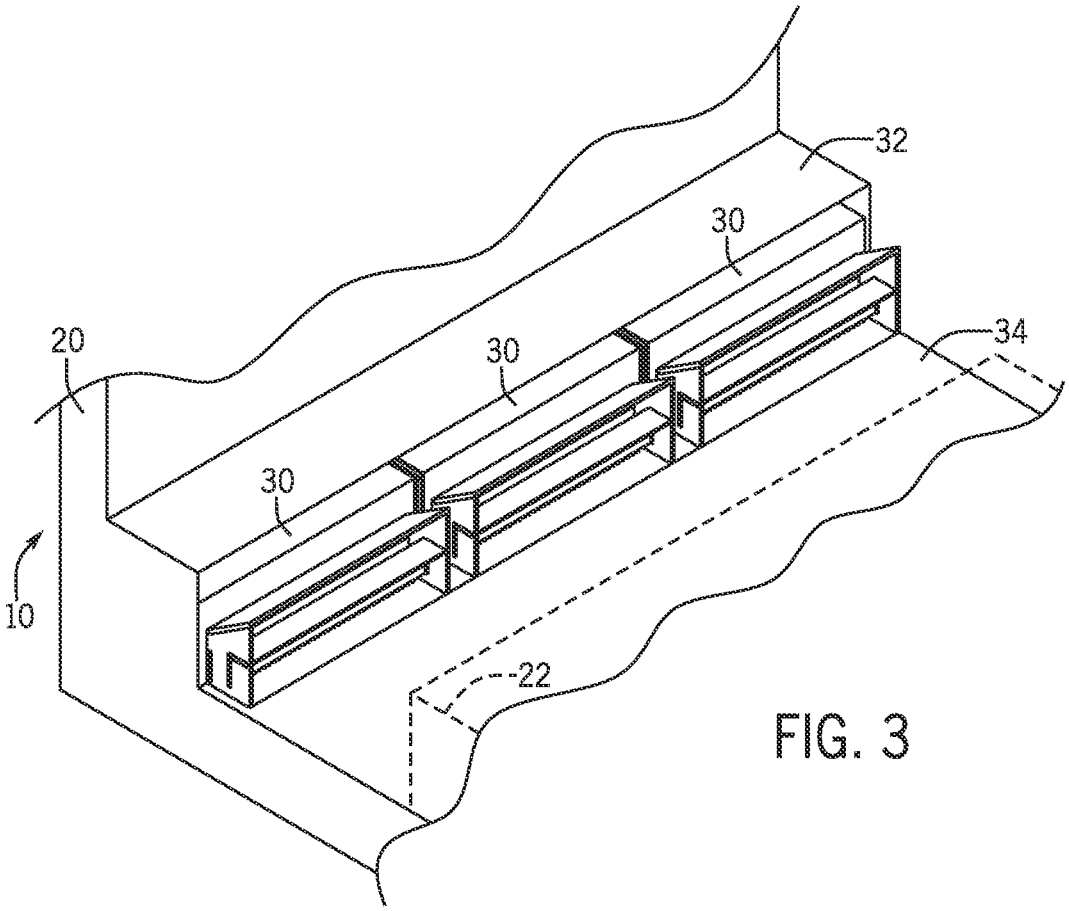
FIG. 3 is a perspective view of multiple air diffusers for use in the HVAC system of FIG. 1, in accordance with an aspect of the present disclosure.

For example, FIG. 3 is a perspective view of an embodiment of multiple air diffusers 30 for use in the HVAC system of FIG. 1. In the illustrated embodiments, the air diffusers 30 are mounted under a ramp 32 connected to the wall 20 of the building 10. However, the air diffusers 30 may be mounted in other locations of the building 10, such as within the walls 20 and/or within the work platform 34. As shown, multiple air diffusers 30 may line the work platform 34 and may be configured to distribute or throw a conditioned air flow into the occupied zone 22. By improving a throw via the disclosed air diffusers 30, conditioned air is not wasted in unoccupied areas outside of the occupied zone 22. In some embodiments, an outlet of the air diffuser 30 may be disposed immediately adjacent to, or within, the occupied zone 22. Further, while the illustrated embodiment includes air diffusers 30 immediately adjacent each other, the air diffusers 30 may be installed or mounted in a spaced configuration. Plenums of the air diffusers 30 may be directly coupled and configured to pass the conditioned air flow to the various air diffusers 30. Additionally or alternatively, ducts may couple between the air diffusers 30 to facilitate distribution of the conditioned air to the various air diffusers 30. Further, a main duct may feed conditioned air to the plenums of the air diffusers 30. Due to efficiency improvement of the air diffusers 30 described in more detail below, the plenums and/or diffuser ducts described above may not require substantial insulating liner, and/or water coils may not be required. For example, a chiller may be utilized to cool the air flow distributed by the air diffusers 30, without requiring additional water coils utilized in traditional embodiments. Detailed aspects of the air diffuser 30 are described below with reference to later drawings.

Figure 4:
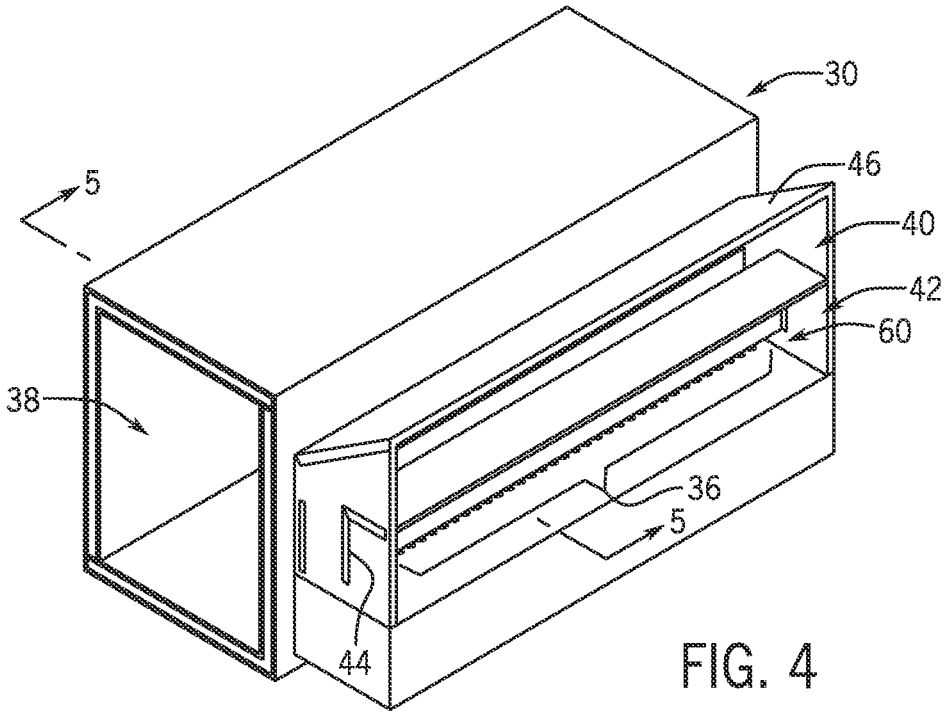
FIG. 4 is a perspective view of one of the air diffusers of FIG. 3, in accordance with an aspect of the present disclosure.

FIG. 4 is a perspective view of an embodiment of one of the air diffusers 30 of FIG. 3. In the illustrated embodiment, the diffuser 30 includes a main plenum 38 configured to receive a conditioned air flow from, for example, another diffuser or from ductwork configured to guide conditioned air to the diffuser 30. The diffuser may include a diffuser inlet (not shown) and diffuser plenum (not shown) which route the conditioned air flow from the main plenum 38 and to nozzles 36 of the diffuser 30. In certain embodiments, the main plenum 38 may directly feed the conditioned air flow to the nozzles 36.

In general, the nozzles 36 may be configured to accelerate the conditioned air flow into a mixing chamber (see mixing chamber 61 in FIG. 5) of the air diffuser 30. For example, the nozzles 36 may include restricted cross-sectional flow path areas which constrict the flow of conditioned air therethrough, causing a vena contract a downstream of each nozzle 36. The mixing chamber, and a corresponding mixing region (see mixing region 62 in FIG. 5) of the mixing chamber are mostly hidden from view in the illustrated embodiment of FIG. 4. Focusing still on FIG. 4, the conditioned air flow from the nozzles 36 may induce room air to enter into the mixing chamber from a room air intake 42 and through a circulation inlet 60. The room air intake 42 may generally refer to an area outside the mixing chamber and communicatively coupled (or a part of) the conditioned space. A blank-off plate 44, for example an L-shaped blank-off plate 44, may be configured to separate the room air intake 42 from the mixing chamber of the air diffuser 30. As the room air is induced into the mixing chamber via the circulation inlet 60 and from the room air intake 42, the room air may adiabatically mix with the conditioned air in the mixing region of the mixing chamber. A mixed air flow may be guided, for example by an additional plate 46 of the air diffuser 30, through a mixed air outlet 40 and into the conditioned space. The above-described adiabatic mixing may be improved by the air diffuser 30 over traditional embodiments, which may improve flow velocity and mixed air temperature.

Figure 5:
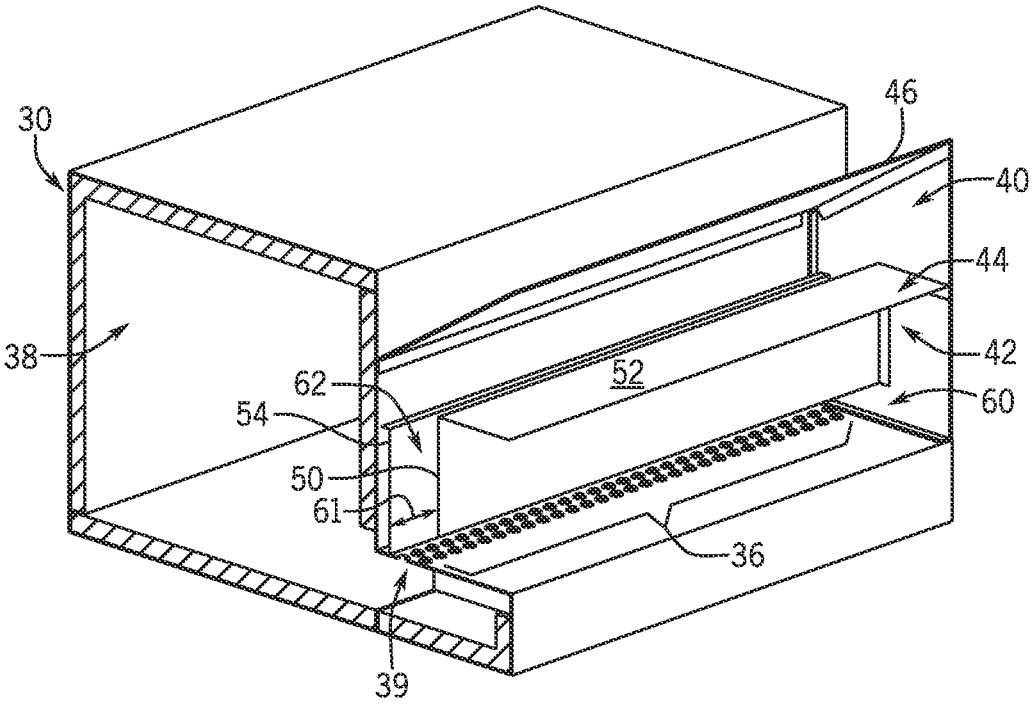
FIG. 5 is a cutaway view of the air diffuser of FIG. 4, taken along line 5-5 in FIG. 4, in accordance with an aspect of the present disclosure.

FIG. 5 is a cutaway view of an embodiment of the air diffuser 30 of FIG. 4, taken along line 5-5 in FIG. 4. The main plenum 38 of the air diffuser 30, as previously described, may be configured to guide a conditioned air flow toward the nozzles 36 of the air diffuser 30. In the illustrated embodiment, a diffuser plenum 39 may receive the conditioned air flow from the main plenum 38, for example via a diffuser inlet not shown in the illustrated embodiment due to the location of the cross-section, such that the diffuser plenum 39 feeds the conditioned air flow to the illustrated nozzles 36. As previously described, the nozzles 36 may be configured to accelerate the conditioned air flow into a mixing region 62 of the mixing chamber 61. The mixing chamber 61 may generally describe the structural features, such as walls of the air diffuser 30 and the nozzles 61 or planar surface 63 in which the nozzles 61 are disposed, which define the mixing region 62.

As previously described, flow of the conditioned air through the nozzles 61 and into the mixing region 62 may induce room air to enter the mixing region 62 through the circulation inlet 60. That is, the circulation inlet 60 and the nozzles 36 may operate as an eductor, whereby the conditioned air flow through the nozzles 36 and into the mixing region 62 causes a pressure difference which induces the room air to enter from the room air intake 42, through the circulation inlet 60, and into the mixing region 62 of the mixing chamber 61. As previously described, the blank-of plate 44 may operate to separate the mixing region 62 from the room air intake 42 such that the room air from the room air intake 42 only enters the mixing region 62 through the circulation inlet 60.

As previously described, the blank-off plate 44 may include an L-shape, including a long segment 50 (e.g., a portion, such as a lower portion) and a short segment 52 (e.g., an additional portion, such as an upper portion). The long segment 50 may define a portion of the mixing chamber 61 that includes the mixing region 62, and the short segment 52 may define a portion of the mixed air outlet 40. As shown, the long segment 50 may substantially separate the mixing region 62 from the room air intake 42, such that the room air is drawn into the mixing region 62 only at the circulation inlet 60 underneath the long segment 50 of the blank-off plate 44. That is, one of ordinary skill in the art would recognize that reference herein to the blank-off plate 44, or long segment 50 thereof, separating the room air intake 42 from the mixing region 62 means that the blank-off plate 44, or long segment 50 thereof, blocks fluid communication between the room air intake 42 and the mixing region 62 except via the illustrated circulation inlet 60, which may be disposed adjacent the nozzles 36 as shown. Thus, a location of room air induction is controlled and allowed only at the circulation inlet 60. By controlling a location and amount of room air drawn through the circulation inlet 60 (e.g., by strategically positioning and sizing the circulation inlet 60, as described in detail with respect to FIG. 6), cooling/heating coils for conditioning the room air are not needed, unlike certain traditional embodiments. That is, the air diffuser 30 in the illustrated embodiment does not include cooling/heating coils, and the circulation inlet 60 is configured to enable the unconditioned room air to enter the mixing region 62 as it is induced by the flow of conditioned air into the mixing region 62 via the nozzles 36. The mixed air may then be routed toward the mixed air outlet 40. The additional plate 46, which may be flat as shown, may define a portion of the mixed air outlet 40, and may be angled in accordance with the description below to improve an air flow velocity and, thus, a throw of the mixed air flow from the mixed air flow outlet 40 of the air diffuser 30.

Figure 6:
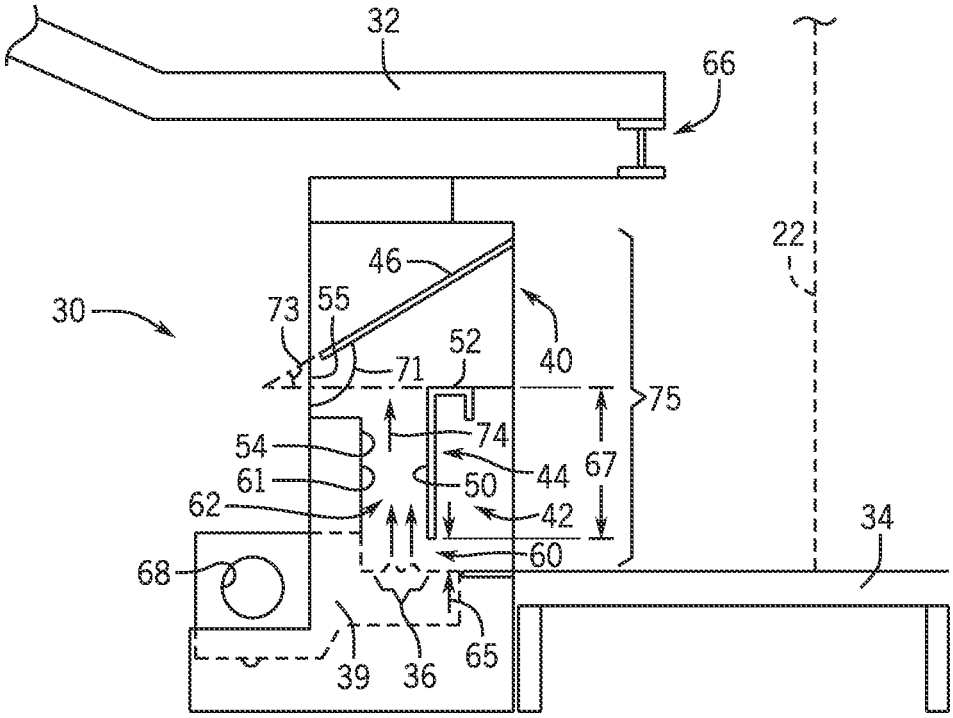
FIG. 6 is a cross-sectional view of the air diffuser of FIG. 4, in accordance with an aspect of the present disclosure.
Figure 7:
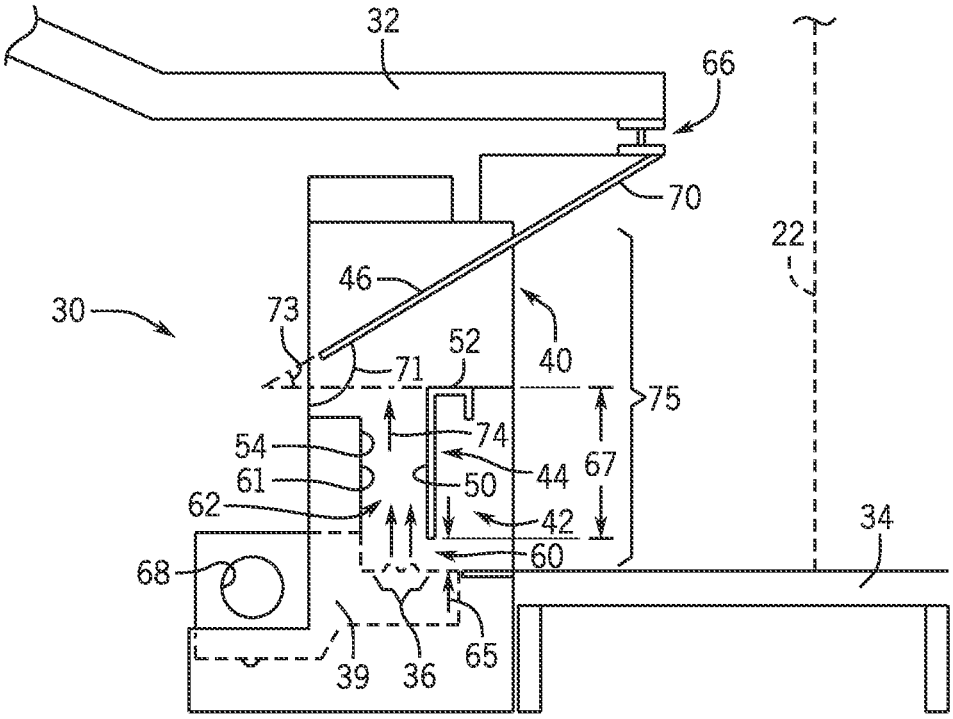
FIG. 7 is a cross-sectional view of an air diffuser for use in the HVAC system of FIG. 1, in accordance with an aspect of the present disclosure.

For example, FIG. 6 is a cross-sectional view of an embodiment of the air diffuser 30 of FIG. 4, and FIG. 7 is a cross-sectional view of another embodiment of the air diffuser 30. Focusing first on FIG. 6, the air diffuser 30 includes an inlet 68 configured to feed the diffuser plenum 39 a flow of conditioned air, such as cooled air or heated air, and the diffuser plenum 39 feeds the conditioned air to the nozzles 36, which accelerate the conditioned air flow into the mixing region 62 of the mixing chamber 61, thereby inducing room air to enter the mixing region 62 through the circulation inlet 60 and from the room air intake 42, as previously described. The long segment 50 of the blank-off plate 44 may generally separate the room air intake 42 from the mixing region 62, such that the room air is drawn into the mixing region 62 from the room air intake 42 only at the circulation inlet 60 underneath the long segment 50 of the blank-off plate 44. That is, one of ordinary skill in the art would recognize that reference herein to the blank-off plate 44, or long segment 50 thereof, separating the room air intake 42 from the mixing region 62 means that the blank-off plate 44, or long segment 50 thereof, blocks fluid communication between the room air intake 42 and the mixing region 62 except via the illustrated circulation inlet 60, which may be disposed adjacent the nozzles 36 as shown. Thus, a location of room air induction is controlled and allowed only at the circulation inlet 60. In particular, in the illustrated embodiment, the circulation inlet 60 includes a height 65 of approximately 1.75 inches (44.45 millimeters), and the long segment 50 of the blank-off plate 44 includes a height 67 of approximately 6 inches (152.4 millimeters). The heights 65, 67 extend along a direction generally parallel to the flow of conditioned air exiting the nozzles 36. Thus, an approximate ratio of the height 65 of the circulation inlet 60 relative to the height 67 of the long-segment 50 of the blank-off plate 44 in the illustrated embodiment is 1:3.4. By limiting the height 65 of the circulation inlet 60, an amount of room air drawn through the circulation inlet 60 is limited and controlled. Further, by locating the circulation inlet 60 immediately adjacent the nozzles 36, a location at which the room air is drawn through the circulation inlet 60 is also controlled.

With the illustrated and described location and sizing of the circulation inlet 60, the disclosed diffuser 30 can recycle room air without having to utilize cooling/heating coils to condition the room air prior to mixing of the room air with the conditioned air in the mixing region 62. That is, the flow of the conditioned air through the nozzles 36 induced unheated/uncooled room air through the circulation inlet 60 and into the mixing region 62, where the room air mixes with the conditioned air passed to the mixing region 62 via the nozzles 36. A similar or same effect can be achieved with slight variances in the ratio of the height 65 of the circulation inlet 60 relative to the height 67 of the long segment 50, which separates the room air intake 42 from the mixing region 62 as previously described. For example, the ratio may be between 1:2-1:5, 1:3-1:4, or 1:3.2-1:3.6. While the height 67 is described above with respect to the long segment 50 of the blank-off plate 44, the blank-off plate 44 in the illustrated embodiment includes an L-shape; thus, the height 67 of the long segment 50 substantially corresponds to the height 67 of the entire blank-off plate 44.

The additional plate 46 and the short segment 52 of the blank-off plate 44 together define a portion of the mixed air outlet 40 of the air diffuser 30. It should be noted that short segment 52 and long segment 44 are descriptive of the illustrated embodiments, but that in other embodiments the portion of the blank-off plate 44 defining the mixed air outlet 40 may be longer than the portion of the blank-off plate 44 defining the mixing chamber and region 61, 62 (and under which the circulation inlet 60 is disposed).

As shown, the additional plate 46 is disposed at an oblique angle relative to walls 54, 55 of the air diffuser 30. For example, the additional plate 46 forms an oblique angle 71 relative to the back wall 55 of the air diffuser 30 and relative to the back wall 54 of the mixing chamber and region 61, 62. It should be noted that, in some embodiments, the back wall 54 of the mixing chamber and region 61, 62 may extend upwardly and intersect with, or contact, the additional plate 46. Further, it should be noted that the additional plate 46 may form the oblique angle 71 with a general flow direction 74 of the mixed air upstream of the additional plate 46. That is, the general flow direction 74 may be substantially parallel to the back wall 54 and/or the back wall 55.

Similarly, the additional plate 46 forms an oblique angle 73 relative to the short segment 52 of the blank-off plate 44 defining the air flow outlet 40. The oblique angle 73 formed by the additional plate 46 (or hypothetical extension thereof) and the short segment 52 (or hypothetical extension thereof) may be between 15 and 45 degrees, 20 and 40 degrees, or 25 and 35 degrees. By angling the additional plate 46 at the oblique angles 71, 73, a Coanda effect may improve the air flow velocity of the mixed air volume output by the mixed air outlet 40. The Coanda effect is generally descriptive of a tendency of a fluid jet to stay attached to a generally curved wall, which may reduce turbulence of the mixed air flow to and through the air flow outlet 40, thereby improving an air flow velocity and throw of the air diffuser 30.

In FIG. 6, the additional plate 46 terminates along a flush face 75 of the air diffuser. However, in some embodiments, the additional plate 46 may extend beyond the face 75. For example, as shown in FIG. 7, the additional plate 46 extends beyond the face 75 and upwardly toward an I-beam 66 or other mounting feature configured to mount between the air diffuser 30 and the ramp 22 under which the air diffuser 30 is disposed. That is, a portion 70 of the additional plate 46 extends beyond the face 75. As shown in both of FIGS. 6 and 7, the mixed air output of the air diffuser 30 may be distributed or thrown from the mixed air outlet 40 and into the occupied zone 22, for conditioning the occupied zone 22.

In FIG. 7, the circulation inlet 60 and the long segment 50 of the blank-off plate 44 are similarly sized as illustrated in FIG. 6 and described above. For example, as similarly described with respect to FIG. 6, the circulation inlet 60 in FIG. 7 includes a height 65 of approximately 1.75 inches (44.45 millimeters), and the long segment 50 of the blank-off plate 44 includes a height 67 of approximately 6 inches (152.4 millimeters). The heights 65, 67 extend along a direction generally parallel to the flow of conditioned air exiting the nozzles 36. Thus, an approximate ratio of the height 65 of the circulation inlet 60 relative to the height 67 of the long-segment 50 of the blank-off plate 44 in the illustrated embodiment is 1:3.4. By limiting the height 65 of the circulation inlet 60, an amount of room air drawn through the circulation inlet 60 is limited and controlled. Further, by locating the circulation inlet 60 immediately adjacent the nozzles 36, a location at which the room air is drawn through the circulation inlet 60 is also controlled.

With the illustrated and described location and sizing of the circulation inlet 60, the disclosed diffuser 30 can recycle room air without having to utilize cooling/heating coils to condition the room air prior to mixing of the room air with the conditioned air in the mixing region 62. That is, the flow of the conditioned air through the nozzles 36 induced unheated/uncooled room air through the circulation inlet 60 and into the mixing region 62, where the room air mixes with the conditioned air passed to the mixing region 62 via the nozzles 36. A similar or same effect can be achieved with slight variances in the ratio of the height 65 of the circulation inlet 60 relative to the height 67 of the long segment 50, which separates the room air intake 42 from the mixing region 62 as previously described. For example, the ratio may be between 1:2-1:5, 1:3-1:4, or 1:3.2-1:3.6. While the height 67 is described above with respect to the long segment 50 of the blank-off plate 44, the blank-off plate 44 in the illustrated embodiment includes an L-shape; thus, the height 67 of the long segment 50 substantially corresponds to the height 67 of the entire blank-off plate 44.

Figure 8:
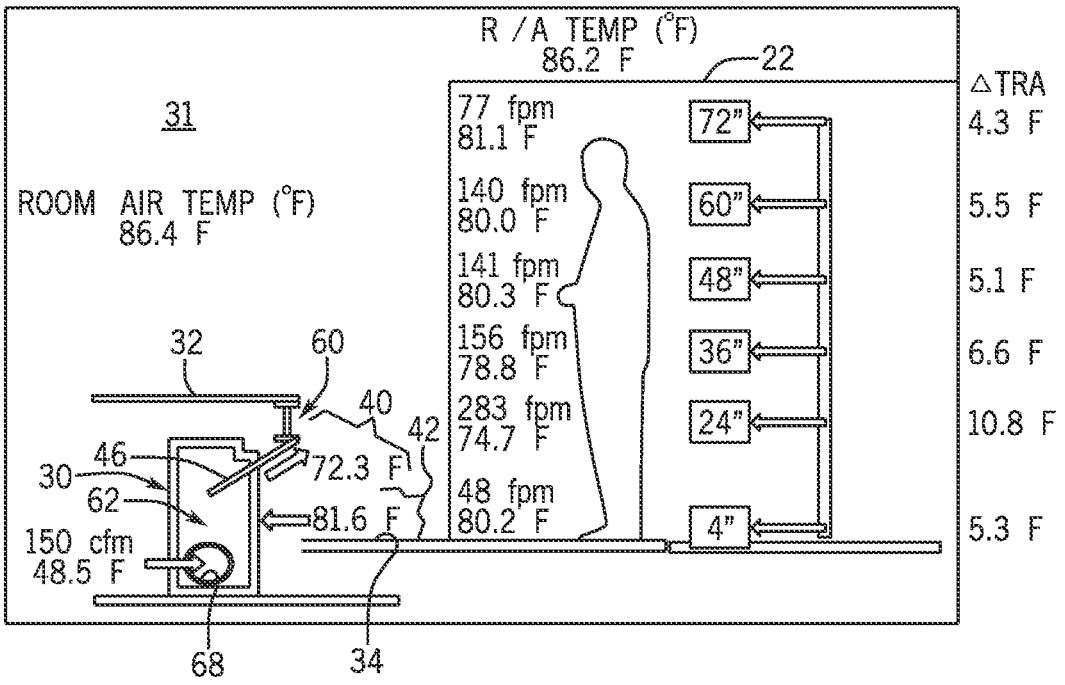
FIG. 8 is a schematic illustration of the HVAC system of FIG. 1 having an air diffuser, in accordance with an aspect of the present disclosure.

FIG. 8 is a schematic illustration of an embodiment of the HVAC system of FIG. 1 having the air diffuser 30. In the illustrated embodiment, cooling results tested for the air diffuser 30 described by the present disclosure are shown. As shown, the general room air temperature in the unoccupied zone 31 is between 85.4 and 86.2 degrees Fahrenheit, whereas the temperature within the occupied zone 22 ranges from 74.7 degrees Fahrenheit to 81.1 degrees Fahrenheit. However, cooling and heating effects may vary based on the cooling/heating features, for example chillers and/or boilers, utilized in the system and the temperature of the conditioned air flow received by the air diffuser 30. As shown, the air diffuser 30 in the illustrated embodiment receives conditioned air flow at 150 cubic feet per minute and at 48.5 degrees Fahrenheit, although different air flow velocities and temperatures are possible based on HVAC equipment. It should be noted that the illustrated results are made possible via the disclosed air diffuser 30 and without the use of expensive water coils present in traditional embodiments. That is, the diffuser 30 is configured to draw uncooled/unheated room air into the mixing region 62 of the diffuser to mix with the pre-conditioned air flow injected into the mixing region 62 via the aforementioned nozzles (e.g., nozzles 36 illustrated in at least FIGS. 4-7).

In accordance with the present disclosure, an air diffuser may include nozzles configured to accelerate a conditioned air flow into a mixing region of the air diffuser, a circulation inlet through which room air is induced from a room air intake and via an eduction effect caused by the conditioned air flow from the nozzle into the mixing region, and a blank-off plate utilized to separate the room air intake from the mixing region and control an entry location of the room air into the mixing region, for example through a circulation inlet disposed under the blank-off plate. Further, a portion of the blank-off plate and an additional plate may form a mixed air outlet through which the mixture of conditioned air and room air is thrown to a conditioned space or occupied zone. The additional plate is disposed at an oblique angle relative to the portion of the blank-off plate, which improves an air flow velocity of the mixed air via, for example, the Coanda effect. By controlling a location of the room air entry into the mixing region, adiabatic mixing and flow velocity may be improved. Further, by angling the additional plate relative to a portion of the blank-off plate defining the mixed air outlet, air flow velocity is improved. Improved mixing and improved air flow velocity may enhance a throw of the mixed air from the mixed air outlet of the air diffuser and into the occupied zone. Further, a temperature of the mixed air flow may be improved via the above-described mixing effects of the disclosed air diffuser.

While only certain features and embodiments of the disclosure have been illustrated and described, many modifications and changes may occur to those skilled in the art, such as variations in sizes, dimensions, structures, shapes and proportions of the various elements, values of parameters including temperatures and pressures, mounting arrangements, use of materials, colors, orientations, etc., without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. An air diffuser, comprising:

a circulation inlet;

a mixing chamber defining a mixing region;

a room air intake fluidly coupled with the mixing region via the circulation inlet;

a nozzle configured to accelerate a conditioned air flow in a direction and into the mixing region such that the conditioned air flow induces unconditioned room air to enter the mixing region through the circulation inlet and from the room air intake;

a blank-off assembly defining a side of the mixing chamber; and a plate having a portion extending at an oblique angle relative to the direction, wherein the portion of the plate and the blank-off assembly define a mixed air outlet configured to output a mixture of the conditioned air flow and the unconditioned room air from the mixing region, and wherein the circulation inlet and the mixed air outlet are arranged on a common side of the air diffuser.

2. The air diffuser of claim 1, wherein the blank-off assembly defines an upper boundary of the circulation inlet.

3. The air diffuser of claim 1, comprising a wall extending in the direction such that the mixing region is defined between the wall and the blank-off assembly.

4. The air diffuser of claim 3, wherein the plate is coupled to the wall.

5. The air diffuser of claim 1, wherein the blank-off assembly comprises a first portion extending in the direction and a second portion extending transverse to the first portion, and the mixed air outlet is defined between the portion of the plate and the second portion of the blank-off assembly.

6. The air diffuser of claim 1, comprising a plenum configured to receive the conditioned air flow from ductwork, wherein the nozzle is disposed between the plenum and the mixing region.

7. The air diffuser of claim 1, wherein the circulation inlet comprises a first height extending in the direction, the blank-off assembly comprises a second height extending in the direction, and a ratio between the first height and the second height is between 1:2 and 1:5.

8. The air diffuser of claim 1, wherein the nozzle is disposed in a wall at least partially defining the mixing chamber.

9. The air diffuser of claim 8, comprising a plurality of nozzles including the nozzle, wherein the plurality of nozzles is disposed in the wall.

10. An air diffuser, comprising:

a wall;

a blank-off assembly opposing the wall;

a mixing region between the wall and the blank-off assembly;

a nozzle configured to accelerate a conditioned air flow into the mixing region such that the conditioned air flow induces unconditioned room air to enter the mixing region from a room air intake; and a flat plate having a proximal end extending from the wall at an oblique angle relative to the wall and a distal end opposing the proximal end, wherein the distal end of the flat plate extends over an upper portion of the blank-off assembly such that the distal end of the flat plate and the upper portion of the blank-off assembly define a mixed air outlet configured to output a mixture of the conditioned air flow and the unconditioned room air from the mixing region.

11. The air diffuser of claim 10, comprising a circulation inlet between the mixing region and the room air intake.

12. The air diffuser of claim 11, wherein the circulation inlet comprises a first height, the blank-off assembly comprises a second height, and a ratio between the first height and the second height is between 1:2 and 1:5.

13. The air diffuser of claim 11, wherein a lower portion of the blank-off assembly opposes the upper portion of the blank-off assembly and defines an upper boundary of the circulation inlet.

14. The air diffuser of claim 10, wherein the blank-off assembly comprises a lower portion opposing the wall such that the mixing region is between the lower portion and the wall, and the upper portion of the blank-off assembly extends from the lower portion of the blank-off assembly such that the mixed air outlet is defined by the upper portion of the blank-off assembly and the distal end of the flat plate.

15. The air diffuser of claim 14, wherein the lower portion of the blank-off assembly extends in a first direction, the flat plate extends in a second direction, and the first direction is transverse to the second direction.

16. The air diffuser of claim 10, wherein the air diffuser is interfaced with a floor such that the mixed air outlet outputs the mixture onto a work platform corresponding to the floor.

17. An air diffuser, comprising:

a circulation inlet including a first dimension extending in a direction;

a mixing chamber defining a mixing region;

a room air intake fluidly coupled with the mixing region via the circulation inlet;

a nozzle configured to accelerate a conditioned air flow into the mixing region such that the conditioned air flow induces unconditioned room air to enter the mixing region through the circulation inlet and from the room air intake;

a blank-off assembly defining a side of the mixing chamber, wherein the blank-off assembly comprises a second dimension extending in the direction, and a ratio between the first dimension and the second dimension is between 1:2 and 1:5; and a mixed air outlet configured to output a mixture of the conditioned air flow and the unconditioned room air from the mixing region, wherein the mixed air outlet is defined by a portion of the blank-off assembly and a plate of the air diffuser.

18. The air diffuser of claim 17, wherein an additional portion of the blank-off assembly defines an upper boundary of the circulation inlet.

19. The air diffuser of claim 17, wherein:

the circulation inlet and the mixed air outlet are disposed on a common side of the air diffuser; and the plate is a flat plate that extends from a wall partially defining the mixing chamber and over the blank-off assembly.

20. The air diffuser of claim 17, wherein the nozzle is oriented to accelerate the conditioned air flow in the direction into the mixing region.

* * * * *